US009745172B2

(12) United States Patent
Gebhardt et al.

(10) Patent No.: US 9,745,172 B2
(45) Date of Patent: Aug. 29, 2017

(54) ELEVATOR CAB PROTECTION SYSTEM

(71) Applicant: InPro Corporation, Muskego, WI (US)

(72) Inventors: David R. Gebhardt, Milwaukee, WI (US); Matthew G. Bennett, New Berlin, WI (US)

(73) Assignee: InPro Corporation, Muskego, WI (US)

( * ) Notice: Subject to any disclaimer, the term of this patent is extended or adjusted under 35 U.S.C. 154(b) by 146 days.

(21) Appl. No.: 14/690,076

(22) Filed: Apr. 17, 2015

(65) Prior Publication Data

US 2016/0304319 A1 Oct. 20, 2016

(51) Int. Cl.

*B66B 11/02* (2006.01)
*E04B 2/90* (2006.01)
*E04B 2/88* (2006.01)

(52) U.S. Cl.

CPC ..... *B66B 11/0253* (2013.01); *B66B 11/0226* (2013.01); *E04B 2/88* (2013.01); *E04B 2/90* (2013.01)

(58) Field of Classification Search

CPC . E04B 2/7457; E04B 2/88; E04B 2/90; E04D 12/004; E04D 2001/3414; B66B 11/0253
USPC ..... 52/551
See application file for complete search history.

(56) References Cited

U.S. PATENT DOCUMENTS 3,187,389 A 6/1965 Anderson
3,521,419 A 7/1970 Fornells
3,631,942 A 1/1972 Brounn
5,265,396 A * 11/1993 Amimoto ..... E04F 13/0855 52/235
5,791,093 A * 8/1998 Diamond ..... E04F 13/12 52/36.5
6,631,589 B1 * 10/2003 Friedman ..... B66B 11/0226 187/401
6,792,727 B2 * 9/2004 Krieger ..... E04C 2/328 52/235
7,089,708 B1 8/2006 Bostock
7,698,865 B2 4/2010 Pringle et al.
7,805,899 B2 * 10/2010 Montgomery ..... E04F 13/081 52/235
8,240,099 B2 * 8/2012 Hummel, III ..... E04F 13/081 52/235
8,336,273 B2 * 12/2012 Enns ..... E04F 13/081 52/302.1
8,347,577 B2 1/2013 Aboukhalil
8,621,810 B2 * 1/2014 Manser ..... E04B 1/4178 52/235

(Continued)

*Primary Examiner* — Paola Agudelo
(74) *Attorney, Agent, or Firm* — Reinhart Boerner Van Deuren s.c.

(57) ABSTRACT

An elevator cab protection system is provided. The system includes first and second panels and three clips. Each of the clips includes a lower leg portion and an upper leg portion. The first clip is coupled to the first panel by a fastener. The lower leg portion of the first clip and the first panel define a first downwardly opening slot. The second clip is coupled to the first panel by a fastener with the upper leg portion of the second clip located above the upper end of the first panel. The third clip is coupled to the second panel by a fastener. The lower leg portion of the third clip is configured to be inserted into the upwardly opening slot defined by the upper leg portion of the second clip and the wall of the elevator cab to support the second panel relative to the first panel.

16 Claims, 15 Drawing Sheets

(56) References Cited

U.S. PATENT DOCUMENTS

| | | | | |
|---|---|---|---|---|
| 8,745,941 | B2 * | 6/2014 | Macdonald | E04F 13/0825 52/235 |
| 8,763,312 | B2 | 7/2014 | Carter | |
| 8,813,451 | B2 | 8/2014 | Foral | |
| 9,080,331 | B2 * | 7/2015 | Aboukhalil | E04F 13/0816 |
| 9,156,658 | B2 * | 10/2015 | Persons, Jr. | B66B 11/0253 |
| 9,464,441 | B2 * | 10/2016 | Wright | E04F 13/0816 |
| 2006/0070329 | A1 | 4/2006 | Schiltz | |
| 2006/0254171 | A1 | 11/2006 | Bostock | |
| 2007/0181380 | A1 * | 8/2007 | Bostock | B66B 11/0253 187/401 |
| 2007/0186501 | A1 | 8/2007 | Kuelker | |
| 2008/0256882 | A1 * | 10/2008 | Kidd | E04F 13/0803 52/235 |
| 2009/0241444 | A1 * | 10/2009 | Griffiths | E04F 13/0889 52/235 |
| 2011/0239578 | A1 | 10/2011 | Wolf et al. | |
| 2012/0304573 | A1 | 12/2012 | Aboukhalil | |
| 2014/0360128 | A1 | 12/2014 | Foral | |

* cited by examiner

ELEVATOR CAB PROTECTION SYSTEM

BACKGROUND OF THE INVENTION

The present invention relates generally to the field of elevators and more specifically to an elevator cab interior protection system.

Elevators, for example, in buildings, may be high-traffic areas, with many people entering, riding in, and exiting the cabs of elevators. For many buildings, e.g., buildings with several floors, skyscrapers, etc., it may be highly inconvenient or impractical for elevators to be taken out of service to repair damage to the interior of the elevator cab. Therefore, interior protection systems may be installed into elevator cabs to protect the cab walls from damage. This may reduce time that elevator cabs need to be out of service to repair damage. Additionally, interiors of elevator cabs may be made to have an aesthetic look that matches other portions of the building.

SUMMARY OF THE INVENTION

One embodiment of the invention relates to an elevator cab protection system for an elevator cab having at least one wall. The system includes a first panel. The first panel extends a first height from a lower end to an upper end. The first panel extends a first width from a first end to a second end. The system includes a second panel. The second panel extends a second height from a lower end to an upper end. The second panel extends a second width from a first end to a second end. The system includes three clips each extending a third width from a first end to a second end. Each of the clips includes a lower leg portion, an upper leg portion, a lower throughbore, and an upper throughbore. The first clip is coupled to the first panel by a first fastener extending through the lower throughbore. The lower leg portion of the first clip and the first panel define a first downwardly opening slot. The second clip is coupled to the first panel by a second fastener with the upper leg portion of the second clip being located above the upper end of the first panel and being configured to define with the at least one wall of the elevator cab a first upwardly opening slot. The third clip is coupled to the second panel by a third fastener. The lower leg portion of the third clip is configured to be inserted into the first upwardly opening slot defined by the upper leg portion of the second clip and the at least one wall of the elevator cab to support the second panel relative to the first panel. The third width is less than the first width.

Another embodiment of the invention relates to a method of protecting the interior of an elevator cab located at a first location. The method includes coupling first and second clips to a first panel and a third clip to a second panel at a second location different than the first location of the elevator cab. The method includes fastening the second clip to a wall of the elevator cab. The wall of the elevator cab and the second clip form an upwardly opening slot. The method includes inserting a portion of the third clip into the upwardly opening slot thereby locating the second panel relative to the first panel.

Another embodiment of the invention relates to an elevator cab protection system for an elevator cab having at least one wall. The system includes a first clip coupled to a first panel by a first fastener. The panel has an upper peripheral edge. The first clip defines a channel extending from below the upper peripheral edge of the panel to a wall above the upper peripheral edge of the panel. The system includes a metal strip configured to be located in the channel. The metal strip has a lower peripheral edge below the upper peripheral edge of the panel and an upper peripheral edge above the upper peripheral edge of the panel. The system includes a second clip coupled to a second panel by a second fastener. The second panel has a lower peripheral edge. The second clip has a downwardly extending leg portion extending downwardly to a lower peripheral edge above the lower peripheral edge of the second panel. The downwardly extending leg portion and the panel define a downwardly opening slot. A portion of the first clip is configured to be received into the downwardly opening slot to locate the second panel relative to the first panel.

Another embodiment of the invention relates to an elevator cab protection system for an elevator cab having at least one wall. The system includes first and second panels each having an upper edge, a lower edge and first and second sides each extending from the upper edge to the lower edge. The system includes a first clip coupled to the first panel by a first fastener and extending past the upper edge of the first panel. The first clip includes a leg portion that with the at least one wall is configured to define an upwardly opening channel. The system includes a second clip coupled to the first panel by a second fastener and extending past the first side of the first panel. The second clip includes a leg portion that with the wall of the elevator cab is configured to define a second channel having a first open end and a second closed end. The system includes a third clip coupled to the second panel by a third fastener. The third clip includes a leg portion that with the panel defines a third channel having a first open end and a second closed end. The leg portion of the third clip is configured to be located in the second channel to locate the second panel horizontally relative to the first panel.

Alternative exemplary embodiments relate to other features and combinations of features as may be generally recited in the claims.

BRIEF DESCRIPTION OF THE DRAWINGS

This application will become more fully understood from the following detailed description, taken in conjunction with the accompanying figures, wherein like reference numerals refer to like elements in which.

DETAILED DESCRIPTION

Referring generally to the figures, various embodiments of an elevator cab interior protection system 100 are illustrated. The system 100 is configured to provide protection for the interior walls of an elevator cab. Additionally, the system 100 may be configured to change the appearance to the interior of the elevator cab, for example, an aesthetic that matches the aesthetic of other portions of the building in which the elevator cab is located. Additionally, the system 100 is configured to be installed onsite into an elevator cab. Therefore, in one embodiment, the system 100 is configured for ease of installation and to minimize or eliminate time-consuming steps that may be incorrectly completed, e.g., eliminating the need to measure the elevator cab onsite at the elevator cab location, eliminating the need to cut and drill at measured locations and to install supports at locations based on the measurements, eliminating the need to modify dimensions of supports for the system onsite at the cab location based on measurements of the cab, etc.

Figure 1:
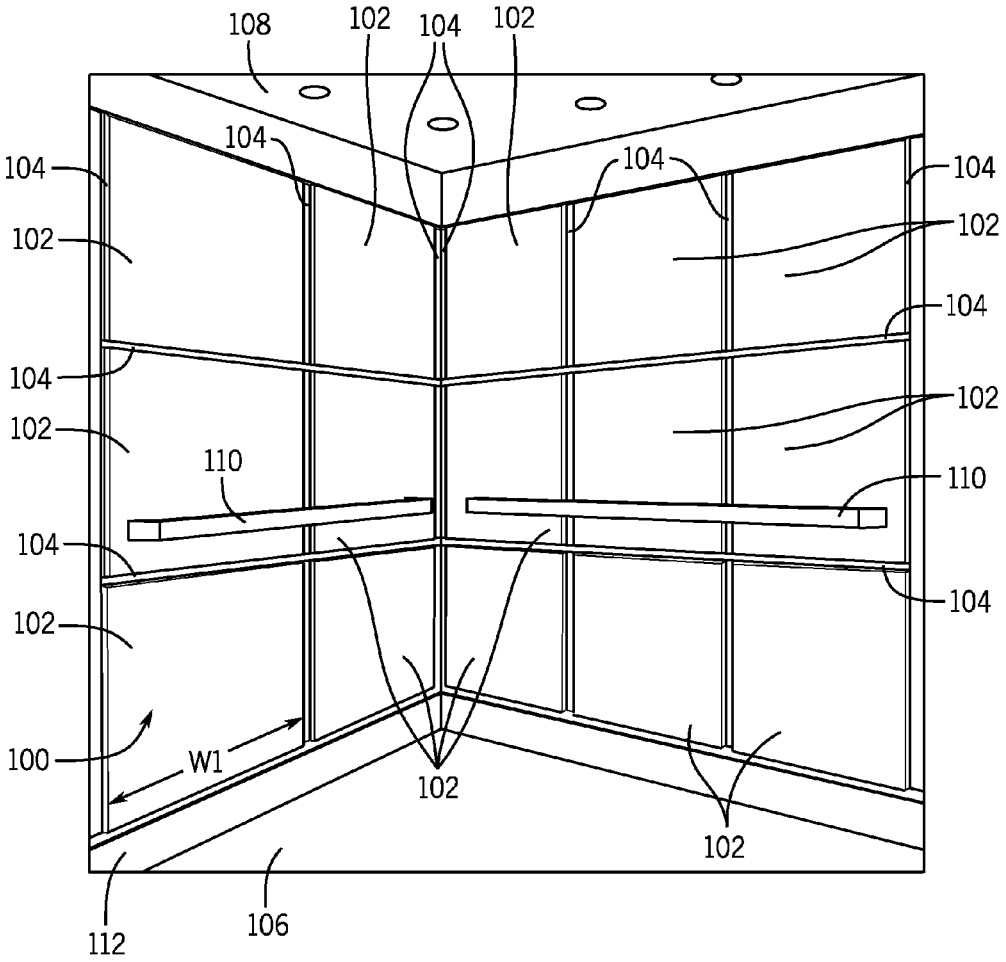
FIG. 1 is a perspective view of an interior of an elevator cab with an elevator cab interior protection system according to an exemplary embodiment.

Referring to FIG. 1, an interior of an exemplary elevator cab is illustrated. An embodiment of an elevator cab interior protection system 100 is shown installed in the elevator cab protecting the walls of the elevator cab. The system 100 includes a plurality of panels 102 supported relative to the walls of the cab (not visible behind the panels 102 in FIG. 1). Located between the panels 102 are strips, e.g., extended width strips, metal or plastic, etc., shown as reveal strips 104. The reveal strips 104 are configured to protect the portions of the cab wall located between the panels 102. The elevator cab includes a floor 106 and a ceiling 108. Extending outwardly from the panels 102 between the floor 106 and the ceiling 108 are railings 110. Proximate the floor 106 of the elevator cab is a toe kick panel 112. In one embodiment, the panels 102 are configured to be installed sequentially upwardly from the toe kick panel 112 up, as will be further described below. In one embodiment, each of the panels 102 extends a width W1. In one embodiment, the width W1 of each of the panels 102 is the same. In other embodiments, the widths of different panels 102 may be different. In one embodiment, the width W1 is between 50 inches and 100 inches. In another embodiment, the width W1 is approximately 96 inches.

Figure 2:
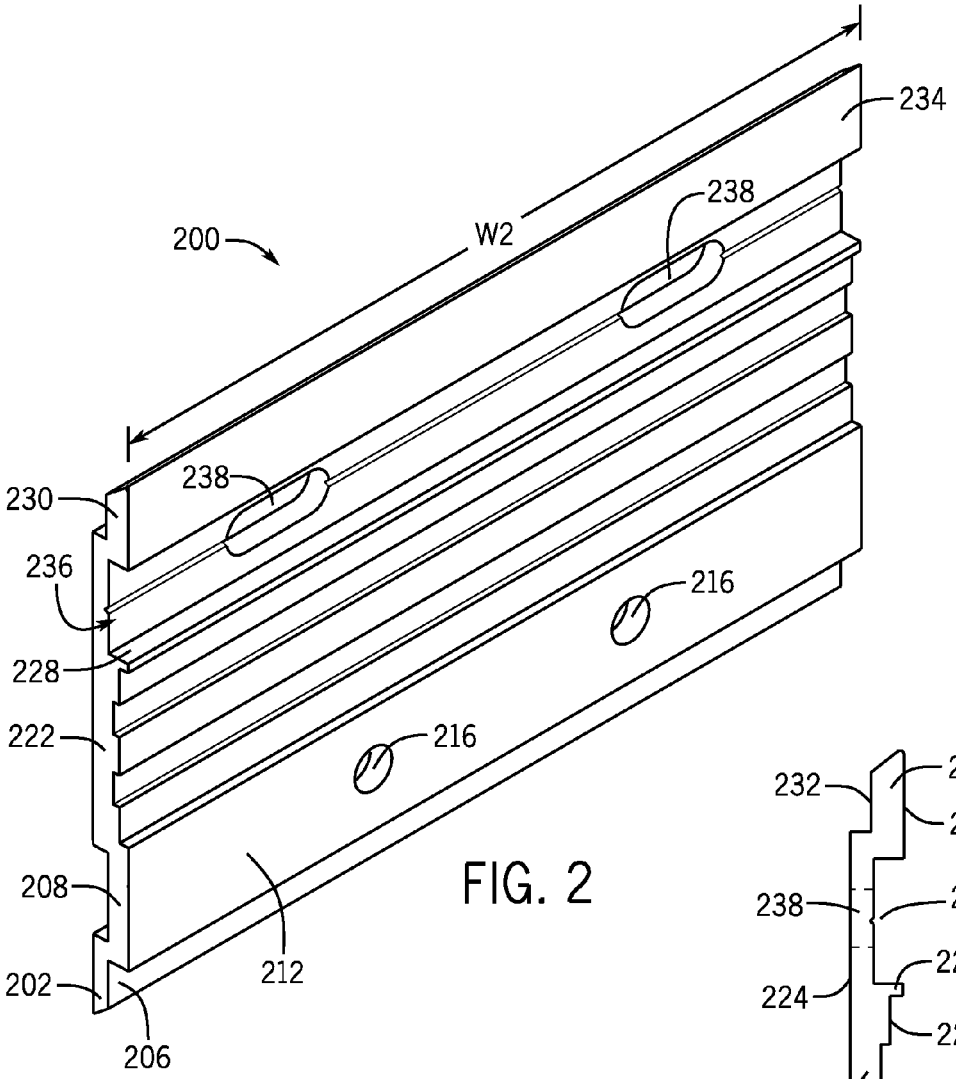
FIG. 2 is a perspective view of a clip according to an exemplary embodiment.
Figure 3:
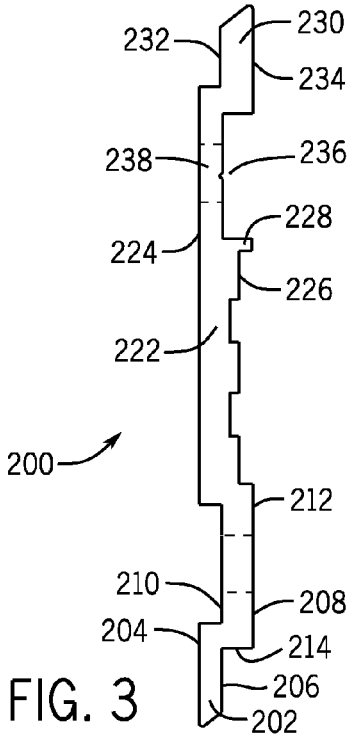
FIG. 3 is a side view of the clip of FIG. 2 according to an exemplary embodiment.
Figure 2A:
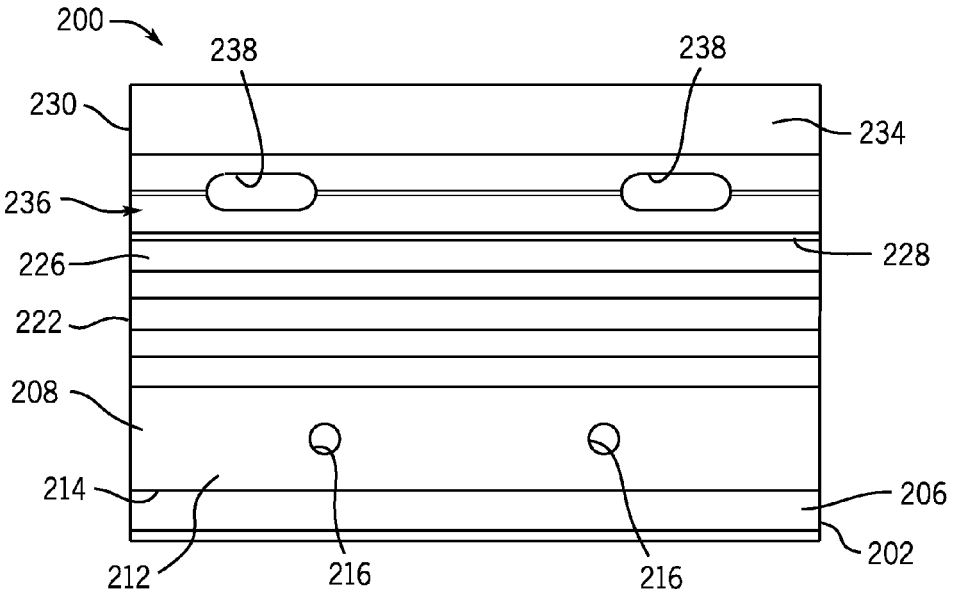
FIG. 2A is a front view of the clip of FIG. 2 according to an exemplary embodiment.
Figure 2B:
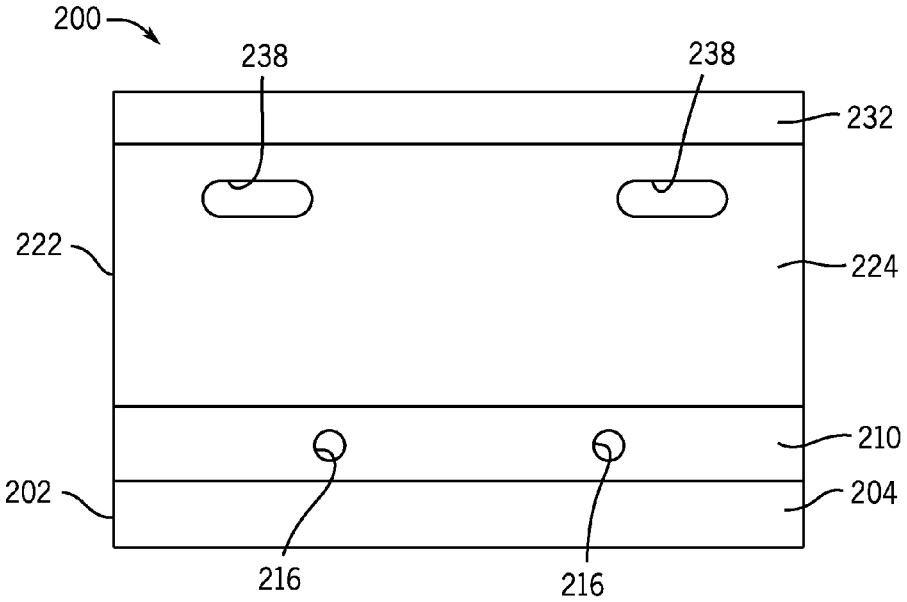
FIG. 2B is a rear view of the clip of FIG. 2 according to an exemplary embodiment.

With reference to FIGS. 2 and 3, an embodiment of a clip 200 is illustrated. The clip 200 is configured to be coupled to an elevator cab wall and to locate and/or support a panel 102 of the elevator cab interior protection system 100 shown in FIG. 1. Multiple identical, e.g., substantially identical, shaped substantially identically, clips 200 are configured to support the panels 102, as will be further described below. The clip 200 includes a lower leg portion 202. The lower leg portion 202 includes a first surface 204 and a second surface 206 opposite the first surface 204. Extending upwardly from the second surface 206 of the lower leg portion 202 is a second portion 208. The second portion 208 has a first surface 210 and a second surface 212 opposite the first surface 210. The second portion 208 defines an overhanging ledge 214. The second portion 208 includes a pair of throughbores 216 spaced apart along the width of the clip 200.

Figure 4:
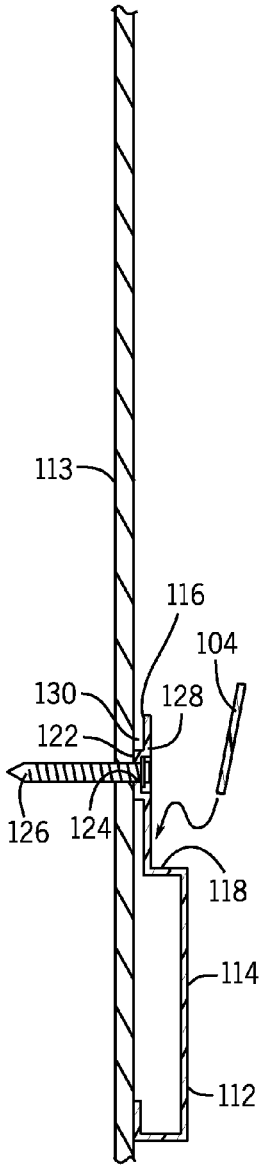
FIG. 4 is a cross-sectional view of an elevator cab wall and a toe kick panel according to an exemplary embodiment.

With reference to FIG. 4, in one embodiment, the toe kick panel 112 is coupled to an elevator cab wall 113. The toe kick panel 112 includes a lower portion 114 and an upper portion 116 extending upwardly from the lower portion 114. The lower portion 114 defines a ledge 118. A reveal strip 104 is located on the ledge 118 with the ledge 118 limiting downward movement of the reveal strip 104. The reveal strip 104 is coupled, e.g., with foam tape and/or adhesive, etc., to the upper portion 116 of the toe kick panel 112 and extends along the width of the toe kick panel 112. The upper portion 116 includes a recessed portion 122 defining a throughbore 124. A fastener shown as a screw 126 extends through the throughbore 124 coupling the toe kick panel 112 to the elevator cab wall 113. The head of the screw 126 is located in the recessed portion 122 such that the reveal strip 104 can be located flush against the upper portion 116, e.g., the head of the screw 126 does not protrude past the outer surface of the upper portion 116. The portion 128 extending upwardly from the recessed portion 122 is spaced apart from the elevator cab wall 113 and with the elevator cab wall 113 defines an upwardly opening slot 130, e.g., with an open upper end, a closed lower end of the slot 130 being defined by the upper periphery of the recessed portion 122 of the upper portion 116.

Figure 5:
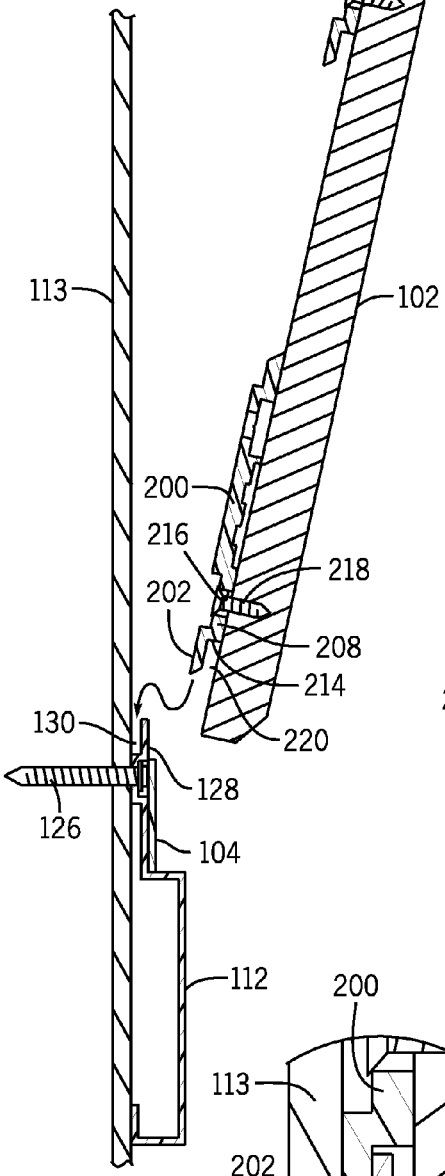
FIG. 5 is a cross-sectional view of a panel and clip being located relative to the toe kick panel of FIG. 4 according to an exemplary embodiment.
Figure 6:
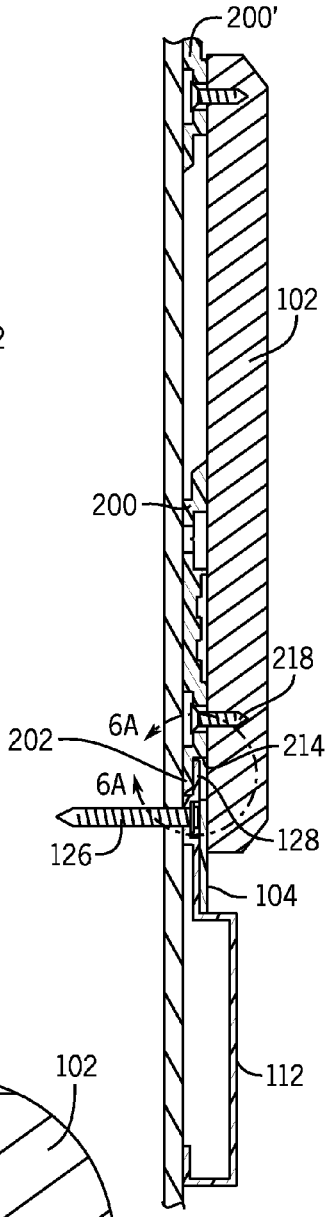
FIG. 6 is a cross-sectional view of the panel and clip of FIG. 5 located relative to the toe kick panel according to an exemplary embodiment.
Figure 6A:
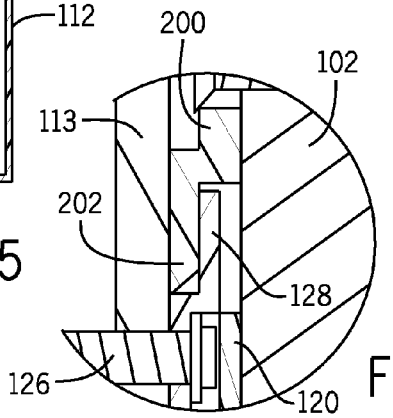
FIG. 6A is a detail view of the area 6A-6A in FIG. 6.

With reference to FIGS. 5, 6, and 6A, in one embodiment, the clip 200 is coupled to the panel 102 by a fastener shown as a screw 218 passing through the throughbore 216. The panel 102 may be assembled with the clip 200 coupled to the panel 102 in a predetermined location on the panel 102, which may reduce assembly time of the system 100 onsite at the location of the elevator cab, reduce opportunity for assembly mistakes, etc. The lower leg portion 202 of the clip 200 with the rear surface of the panel 102 defines a downwardly opening slot 220, e.g., with an open lower end. The panel 102 is lowered relative to the toe kick panel 112 to locate the lower leg portion 202 of the clip 200 in the slot 103 and to locate the portion 128 of the toe kick panel 112 in the slot 220, thereby locating and/or supporting the panel 102 relative to the toe kick panel 112 and the elevator cab wall 113.

With further reference to FIGS. 2 and 3, in one embodiment, the clip 200 includes a third portion 222 extending upwardly from the second portion 208. The third portion 222 has a first surface 224 and a second surface 226 opposite the first surface 224. The first surface 224 is located in the same plane as the first surface 204 of the lower leg portion 202. The third portion 222 includes a wall portion 228 extending generally perpendicular to the first surface 224. Extending upwardly from the third portion 222 is an upper leg portion 230. The upper leg portion 230 has a first surface 232 and a second surface 234 opposite the first surface 232. The first surface 232 is located in a plane that is offset, e.g., non-coplanar, from the plane in which the first surface 224 of the third portion 222 is located. The upper leg portion 230 and the wall portion 228 define a channel 236 therebetween. The third portion 222 defines a pair of throughbores 238 spaced apart along the width of the clip 200. The channel 236 is configured such that heads of fasteners passing through the throughbores 238 may be located in the channel 236, e.g., not protrude pas the surface 234.

The clip 200 extends a width W2. The width W2 is less than the width W1 (see FIG. 1) of the panel 102. In one embodiment, the width W2 is between 1 inch and 24 inches. In another embodiment, the width W2 is 4 inches. In one embodiment, the width W2 is between 1% and 60% of the width W1. In another embodiment, the width W2 is between 3% and 25% of the width W1. In another embodiment, the width W2 is 5% of the width W1.

Figure 7:
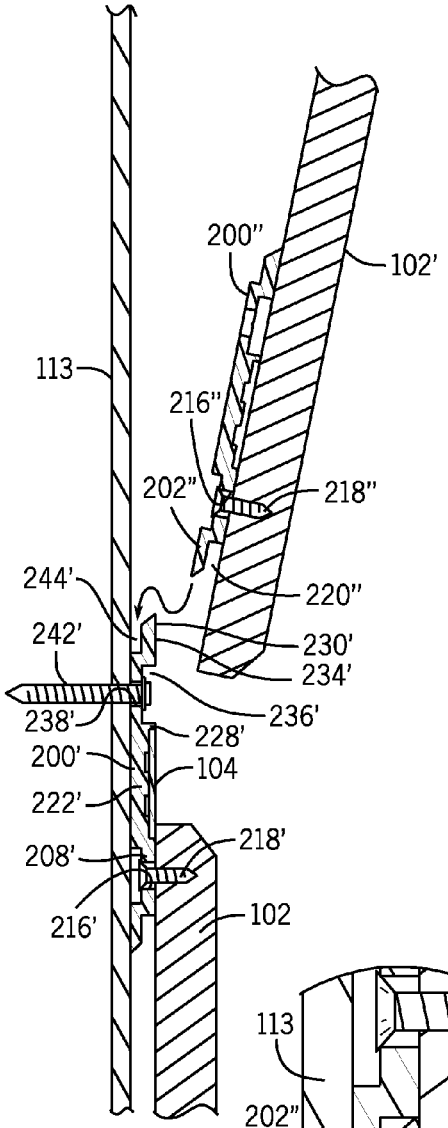
FIG. 7 is a cross-sectional view of another panel and clip being located relative to the panel of FIG. 6 according to an exemplary embodiment.

With reference to FIG. 7, a second clip 200' identical, e.g., substantially identical, to the first clip 200 is coupled to the upper end of the panel 102 by second fasteners shown as second screws 218' (only one screw 218' visible in FIG. 7) passing through the throughbores 218. A reveal strip 104 is located between the wall portion 228' and the upper periphery of the second portion 208' of the second clip 200' and trapped in place between the third portion 222' and the surface of the panel 102. Another pair of fasteners shown as screws 242' (only one visible in FIG. 7) extend through the throughbores 238' coupling the clip 200' to the elevator cab wall 113. The heads of the screws 242' are located in the channel 236' such that the heads do not extend outwardly past the second surface 234' of the upper leg portion 230'. The upper leg portion 230 and the elevator cab wall 113 define an upwardly opening slot 244', e-g., with an open upper end.

With further reference to FIG. 7, another panel 102' is provided. In one embodiment, the panel 102' is identical, e.g., substantially identical to the panel 102. A third clip 200" is also provided. In one embodiment, the clip 200" is identical, e.g., substantially identical, to the clips 200 and 200'. The third clip 200" is coupled to the second panel 102' by a pair of fasteners shown as screws 218" (only one screw 218" visible in FIG. 7) extending through the pair of throughbores 216". The lower leg portion 202" of the clip 200" and the panel 102' define a slot 220" with a lower open end.

Figure 8:
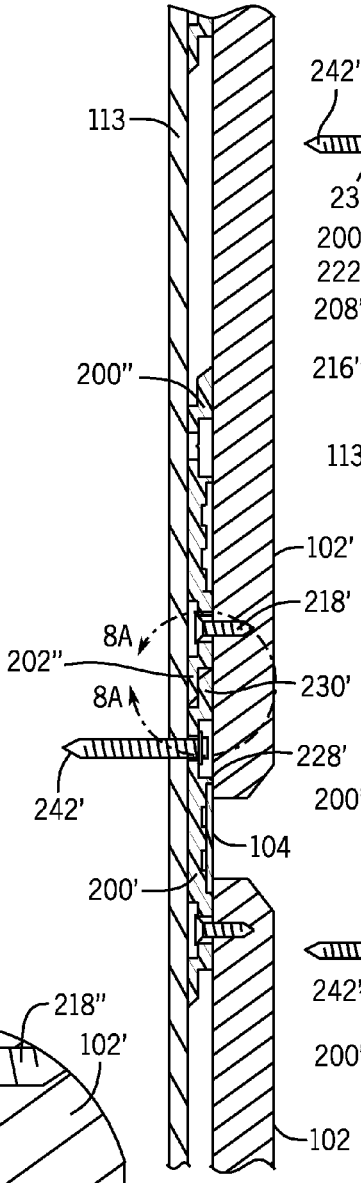
FIG. 8 is a cross-sectional view of the panels of FIG. 7 located relative to one another according to an exemplary embodiment.
Figure 8A:
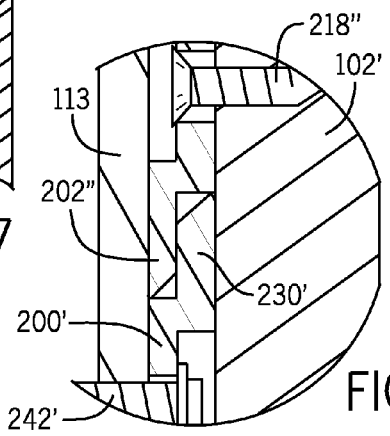
FIG. 8A is a detail view of the area 8A-8A in FIG. 8.
Figure 10:
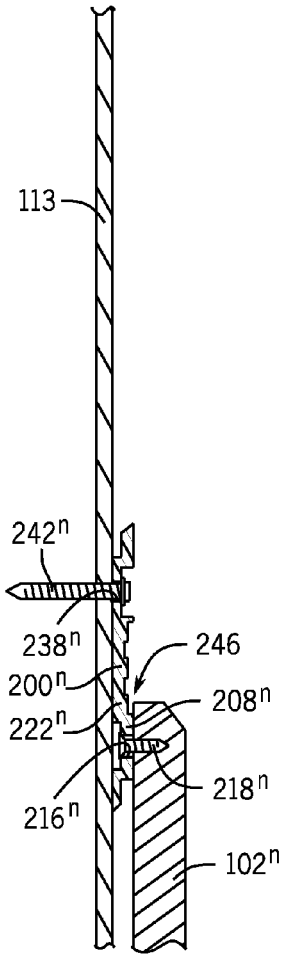
FIG. 10 is a cross-sectional view of another clip and panel according to an exemplary embodiment.
Figure 11:
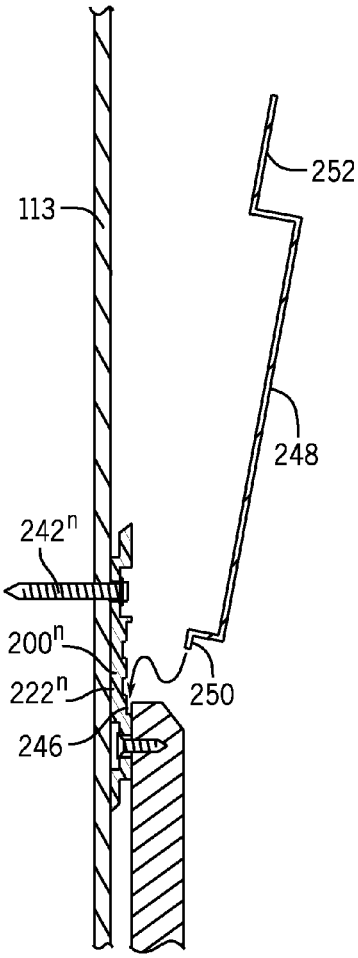
FIG. 11 is a cross-sectional view of a frieze being located relative to the clip and panel of FIG. 10 according to an exemplary embodiment.
Figure 12:
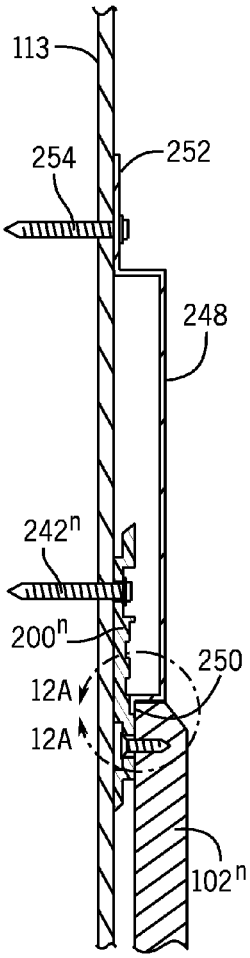
FIG. 12 is a cross-sectional view of the frieze, clip, and panel of FIG. 11 located relative to one another according to an exemplary embodiment.
Figure 12A:
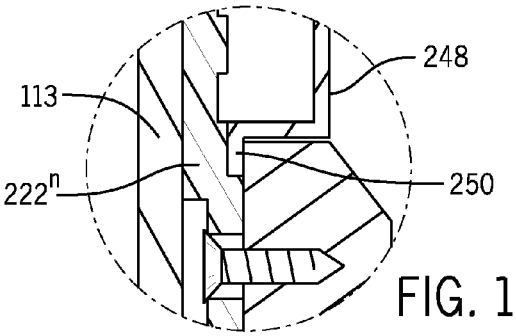
FIG. 12A is a detail view of the area 12A-12A in FIG. 12.

With reference to FIGS. 7, 8, and 8A, in one embodiment, the lower leg portion 202" is located in the slot 244' and the upper leg portion 230' is located in the slot 220" to support the second panel 102' relative to the first panel 102 and the elevator cab wall 113.

Figure 9:
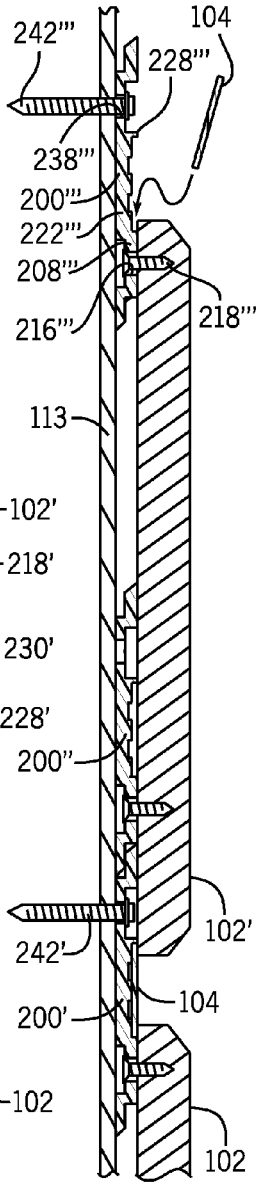
FIG. 9 is a cross-sectional view of another clip and a reveal located relative to the panels of FIG. 8 according to an exemplary embodiment.

With reference to FIG. 9, another clip 200''' is provided. In one embodiment, the clip 200''' is identical, e.g., substantially identical to the clips 200, 200', and 200". The clip 200''' is coupled to the upper end of the panel 102' by a pair of fasteners shown as screws 218''' (only one screw 218''' visible in FIG. 9) passing through the throughbores 216'''. The clip 200''' is coupled to the elevator cab wall 113 by a pair of fasteners shown as screws 242''' (only one screw 242''' visible in FIG. 9) passing through the throughbores 238". Another reveal strip 104 is located between the wall portion 228''' and the upper periphery of the second portion 208''' of the clip 200''' and trapped in place between the third portion 222" and the rear surface of the panel 102'.

Additional panels may be similarly sequentially upwardly installed until a desired portion of the elevator cab wall 113 is covered. With reference to FIGS. 10-12A, the last panel 102$^{n}$ to be installed in the elevator cab is coupled to a clip 200$^{n}$, in one embodiment, a clip 200$^{n}$ identical, e.g., substantially identical, to the clips described above, by a pair of fasteners shown as screws 218$^{n}$ (only one screw 218$^{n}$ visible in FIG. 10) extending through the throughbores 216$^{n}$. The third portion 222$^{n}$ and the panel 102$^{n}$ define an upwardly opening slot 246$^{n}$, e.g., with an open upper end. An upper panel shown as an upper frieze 248 is provided. The upper frieze 248 includes a downwardly extending flange 250 configured to extend into the slot 246. The upper frieze 248 also includes an upper flange 252. The upper flange is configured to be coupled to the elevator cab wall by a fastener shown as a screw 254.

Figure 13:
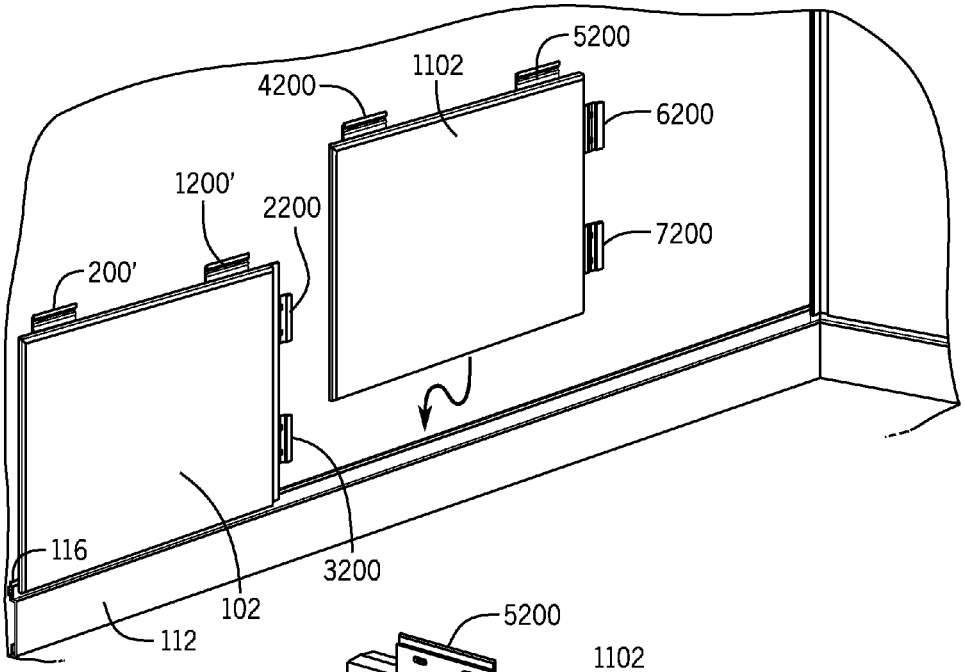
FIG. 13 is a perspective view of a panel being located next to the panel of FIG. 6 according to an exemplary embodiment.

With reference to FIG. 13, in one embodiment, the panel 102 is provided with a second clip 1200'. The second upper clip 1200' is identical, e.g., generally identical, shaped generally identically, etc., to the clip 200' and is coupled to the panel 102 spaced apart from the clip 200' and functions similarly to the clip 200' interacting with another clip on a panel above. The panel 102 is also provided with side clips 2200 and 3200. The side clips 2200 and 3200 are identical, e.g., generally identical, shaped generally identically, etc., to the clip 200'. The side clips 2200 and 3200 are rotated 90° relative to the clips 200' and 1200', spaced apart and coupled to the panel 102, and extend laterally beyond the periphery of the panel 102.

Figure 14:
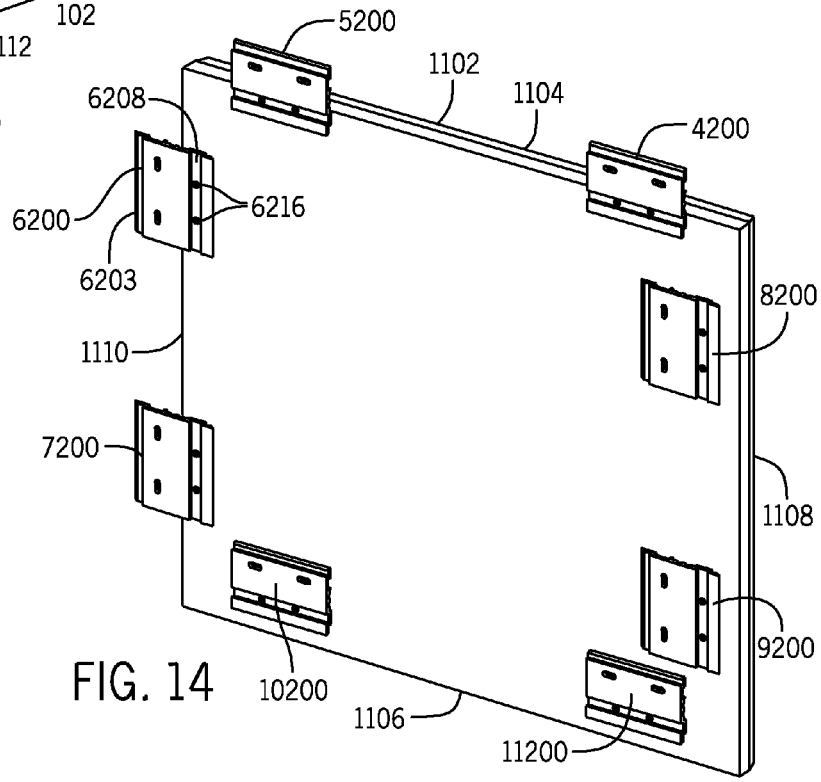
FIG. 14 is a rear view of a panel of FIG. 13 according to an exemplary embodiment.

With reference to FIGS. 13 and 14, in one embodiment, another panel 1102 is provided. In one embodiment, the panel 1102 is identical, e.g., generally identical, generally identically shaped and sized, etc., to the panel 102. The panel 1102 has an upper edge 1104, a lower edge 1106, and first and second side edges 1108 and 1110 extending between the upper 1104 and lower 1106 edges. Additional clips 4200, 5200, 6200, 7200, 8200, 9200, 10200, and 11200 are provided. The clips 4200, 5200, 6200, 7200, 8200, 9200, 10200, and 11200 are identical, e.g., generally identical, generally identically shaped and sized, etc., to the clip 200'. The clips 4200 and 5200 are positioned similarly to the clips 200' and 1200' and configured to similarly interact with clips on a panel above as described above relative to the panel 102. The clips 10200 and 11200 are coupled to the panel 1102 proximate the lower edge 1106 and are configured to interact with the toe kick panel 112 similarly to the clip 200 (see FIG. 5) described above. The clip 6200 is coupled to the panel by fasteners extending through throughbores 6216 in the second portion 6208 of the clip 6200. The leg portion 6203 extends out past the side edge 1110 of the panel 1102. The clip 7200 is similarly coupled to the panel 1102 between the clip 6200 and the lower edge 1106. The clips 8200 and 9200 are similarly coupled to the panel 1102 and oriented similarly relative to the panel 1102, however, the clips 8200 and 9200 are located inwardly from the edge 1108 such that the clips 8200 and 9200 do not extend past the edge 1108.

Figure 15:
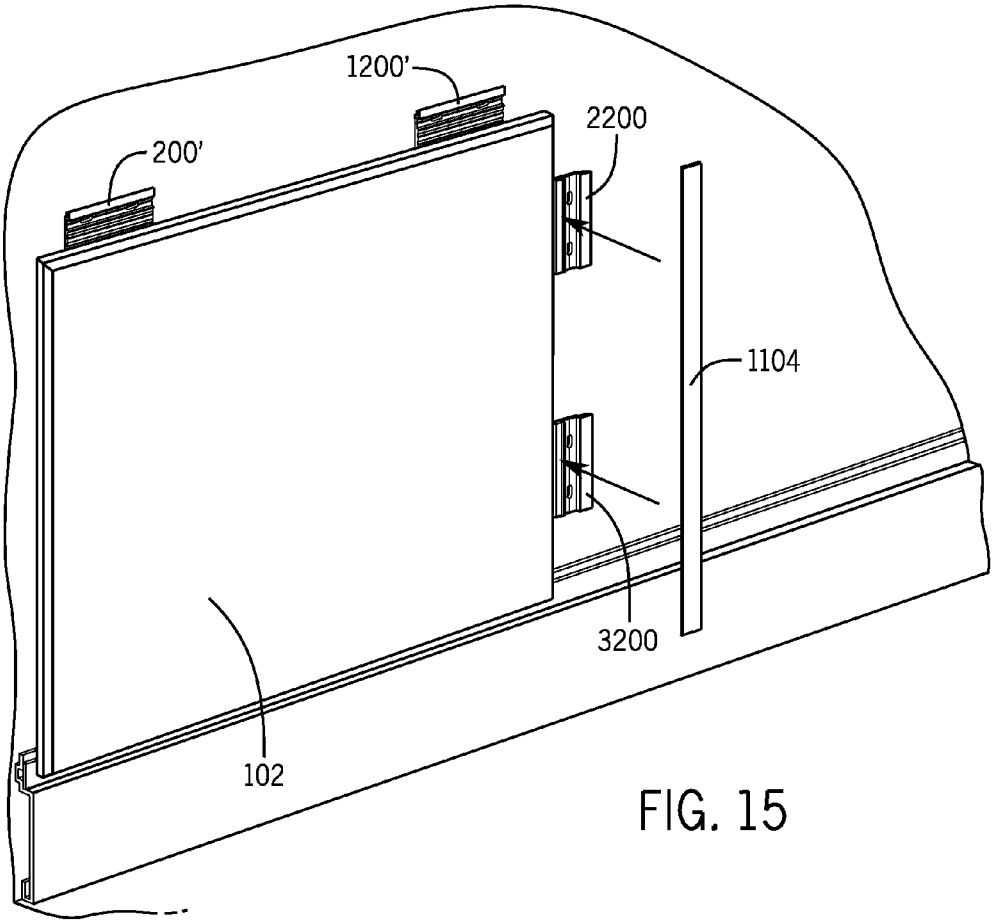
FIG. 15 is a perspective view of a vertical reveal strip being located relative to the panel of FIG. 6.
Figure 16:
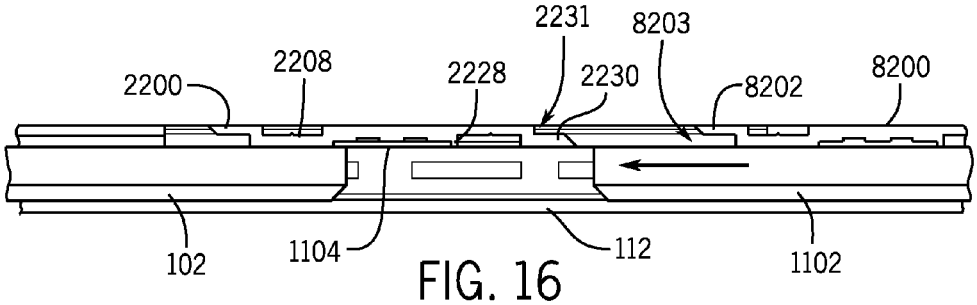
FIG. 16 is a top view of the panels of FIG. 13 being located relative to one another according to an exemplary embodiment.
Figure 17:
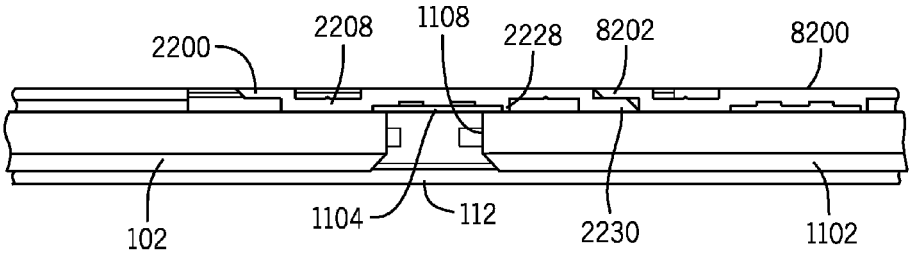
FIG. 17 is a top view of the panels of FIG. 16 located relative to one another according to an exemplary embodiment.

In one embodiment, the clips 8200 and 9200 are configured to interact with the clips 2200 and 3200 respectively to locate the panel 1102 relative to the panel 102 and to hold a vertical reveal in place as is further described below. With reference to FIGS. 15-17, a strip shown as a vertical reveal strip 1104 is provided. In one embodiment, the vertical reveal strip 1104 is similar, e.g., made of similar material, of similar appearance, etc., to the reveal strips 104 described above. The vertical reveal strip 1104 is located in the channel formed between the wall portion 2228 and the second portion 2208. The channel and thus the vertical reveal strip 1104 extends past the edge of and behind the panel 102.

With further reference to FIGS. 16 and 17, the leg 2230 of the clip 2200 with the wall of the elevator defines a slot 2231 that is open at one end and closed at the other end. The leg 8202 with the panel 1102 defines a slot 8203 that is open at one end and closed at the other end. The panel 1102 is configured to be moved or slid toward the panel 102 to locate the leg 2230 in the channel 8203 and the leg 8202 in the channel 2231. With the leg 2230 located in the channel 8203 and the leg 8202 located in the channel 2231, the vertical reveal strip 1104 extends past the side 1108 of and behind the panel 1102. Thus, the vertical reveal strip 1104 is held in the channel between the wall portion 2228 and the second portion 2208 of the clip 2200 (and similarly in the channel of the clip 3200) on one side by the panel 102 and on the opposite side by the panel 1102. In one embodiment, the clips 9200 and 3200 interact similarly to locate the panel 1102 relative to the panel 102.

Additional clips attached to additional panels can be used to interact with the clips 6200 and 7200 to locate an additional panel relative to the panel 1102. This process with additional clips and panels can be repeated until the elevator cab wall is covered.

In one embodiment, the clips are attached to the panels at predetermined locations on the panels such that the panels can simply be slid together by an installer at the location of the elevator cab with the assembled elevator cab interior protection system precisely fitting together and covering the elevator wall.

Figure 18:
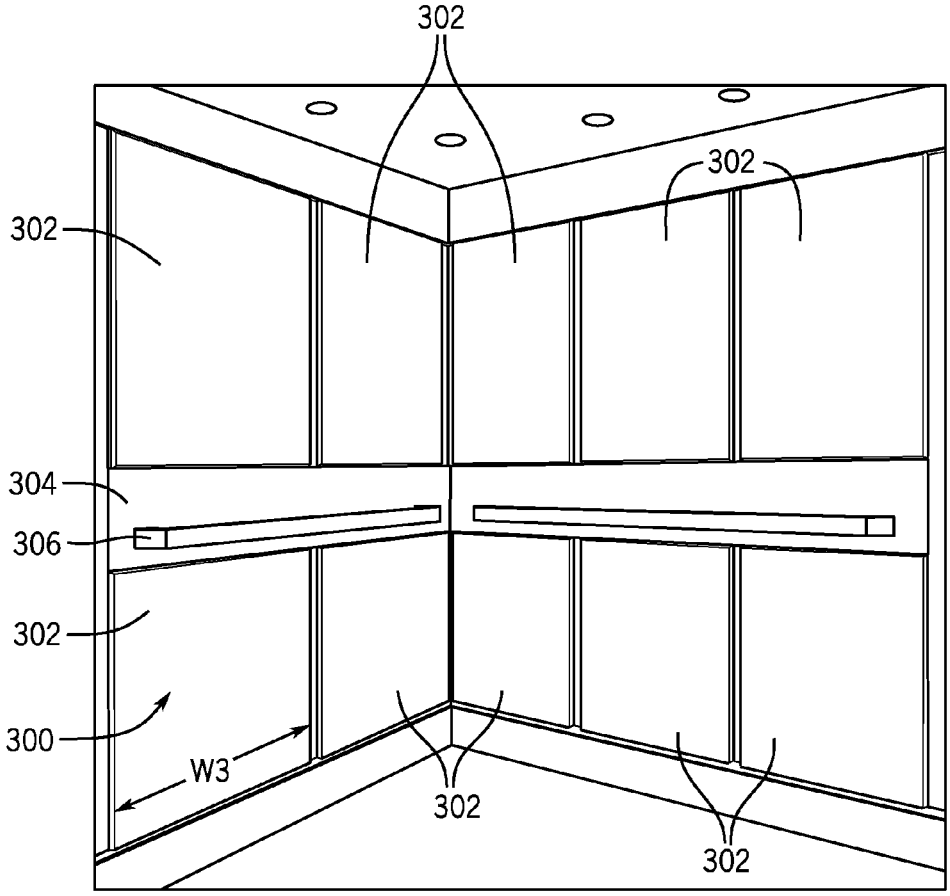
FIG. 18 is a perspective view of an interior of an elevator cab with an elevator cab interior protection system according to an exemplary embodiment.

With reference to FIG. 18, another embodiment of an elevator cab interior protection system 300 is illustrated. In various embodiments, it may be desirable to include between panels 302 an extended reveal portion 304, for example, proximate and/or behind a handrail 306. The system 300 uses clips 102 as described above in combination with retainers shown as reveal retainers 308. The panels 302 extend a width W3. In one embodiment, the extended reveal portion 304 extend a height greater than the height of the reveal portions described above. In one embodiment, the extended reveal portions 304 extend a height between 5 and 12. In one embodiment, the extended reveal portions 304 extend a height ten times greater than the width of the reveal strips 104 described above.

Figure 19:
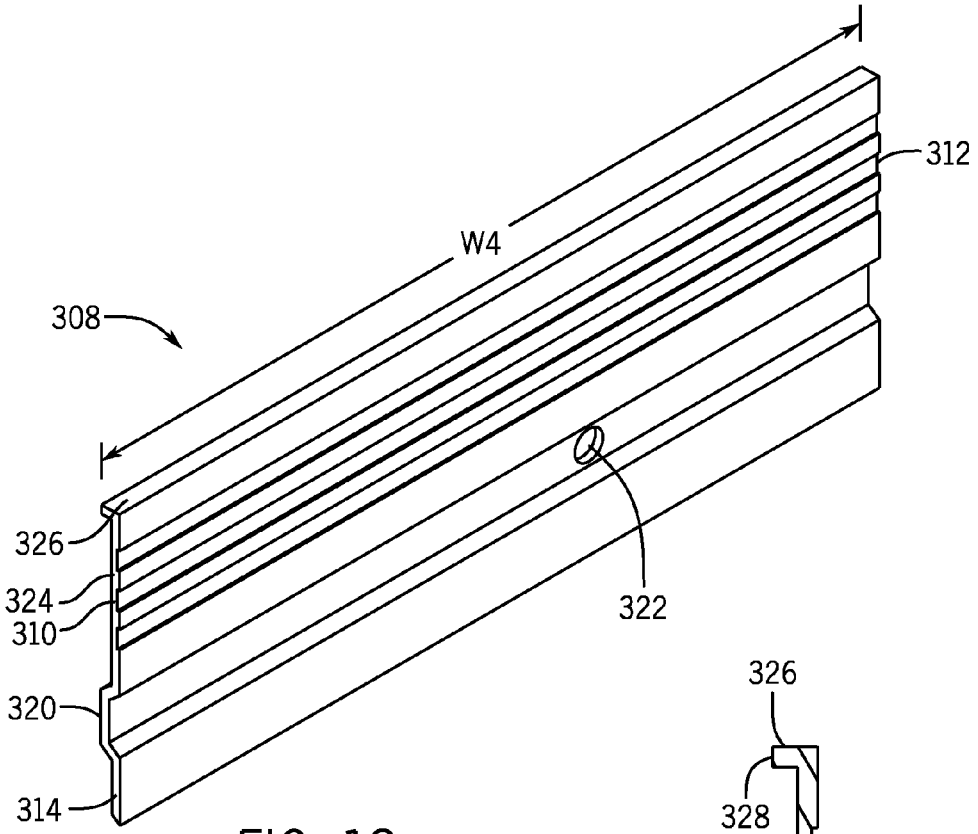
FIG. 19 is a perspective view of a reveal retainer according to an exemplary embodiment.
Figure 20:
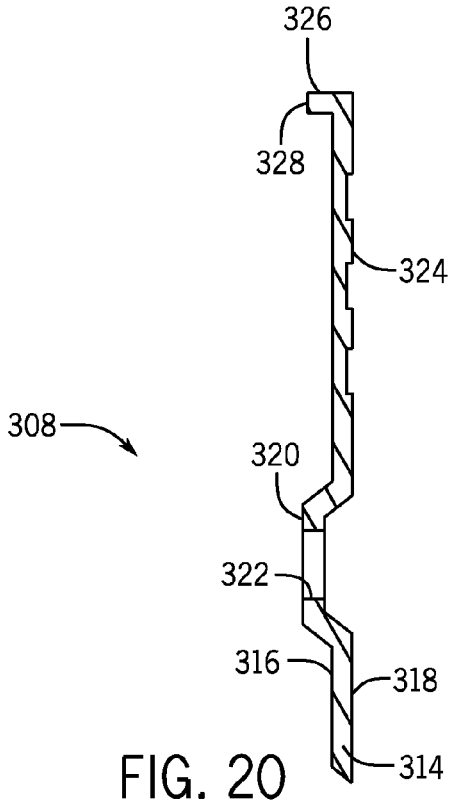
FIG. 20 is a side view of the reveal retainer of FIG. 14 according to an exemplary embodiment.

With reference to FIGS. 19 and 20, an embodiment of a reveal retainer 308 is illustrated. The reveal retainer 308 extends a width W4 from a first end 310 to a second end 312. In one embodiment, the width W4 of the reveal retainer 308 is less than the width W3 of the panels 302. In one embodiment, the width W4 is between approximately 1 inch and 8 feet. The reveal retainer 308 includes a lower portion 314 having a first surface 316 and a second surface 318 opposite the first surface 316. The reveal retainer 308 includes a recessed portion 320 extending upwardly from the lower portion 314. The recessed portion 320 includes a throughbore 322 configured to receive a fastener therethrough. Extending upwardly from the recessed portion 320 is a third portion 324. The third portion 324 extends from the recessed portion 320 to an upper flange 326. The upper flange 326 extends to an inner peripheral surface 328. The surface 328 lies in a plane that is not co-planar with the plane in which the surface 316 is located.

Figure 21:
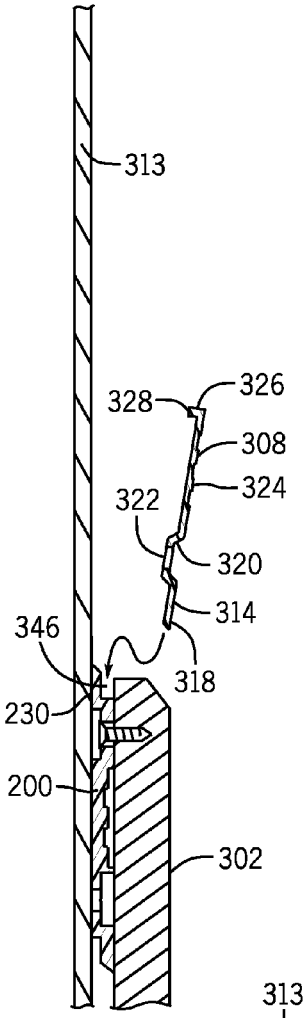
FIG. 21 is a cross-sectional view of a clip, panel, reveal retainer, and elevator cab wall according to an exemplary embodiment.
Figure 22:
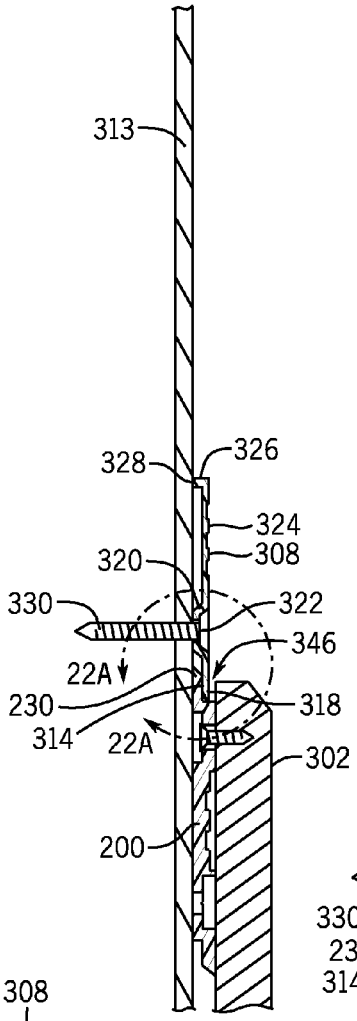
FIG. 22 is a cross-sectional view of the clip, panel, and reveal retainer located relative to the elevator cab wall of FIG. 16 according to an exemplary embodiment.
Figure 23:
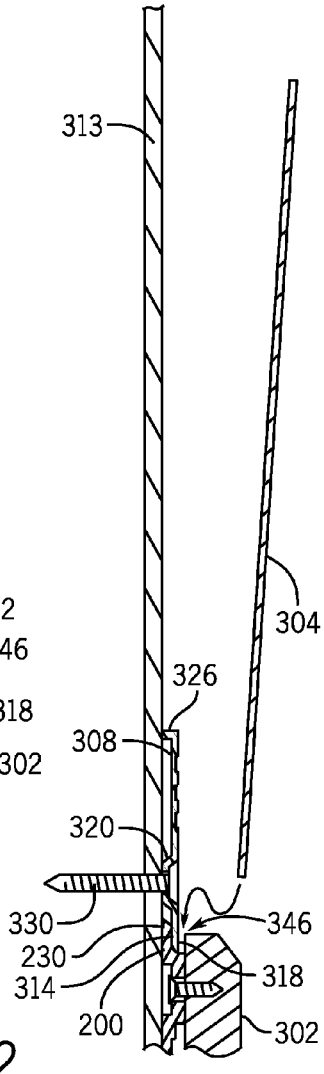
FIG. 23 is a cross-sectional view of an extended reveal being located relative to the clip, panel, and reveal retainer of FIG. 17 according to an exemplary embodiment.
Figure 22A:
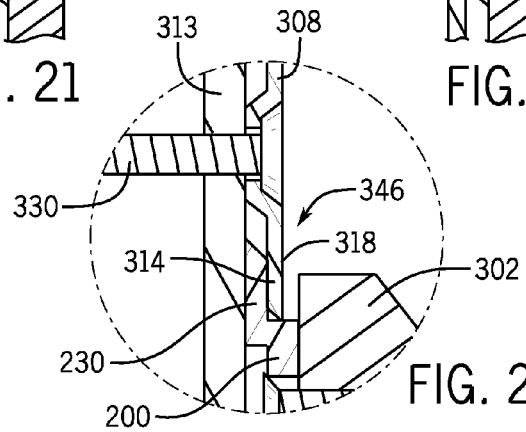
FIG. 22A is a detail view of the area 17A-17A in FIG. 17.
Figure 24:
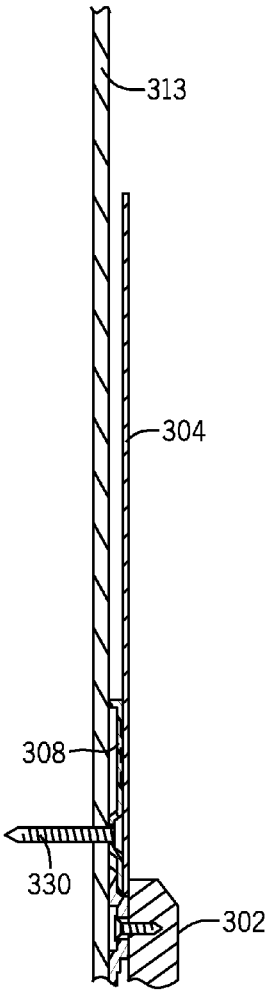
FIG. 24 is a cross-sectional view of the extended reveal located relative to the clip, panel, and reveal retainer of FIG. 18 according to an exemplary embodiment.
Figure 25:
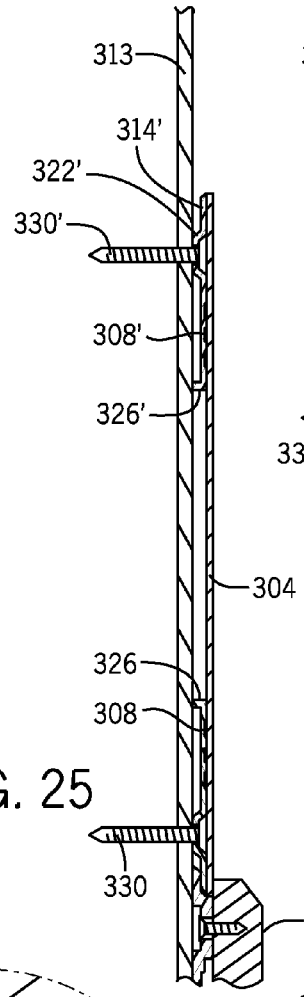
FIG. 25 is a cross-sectional view of a second reveal retainer located relative to the extended reveal, clip, panel, and reveal retainer of FIG. 19 according to an exemplary embodiment.
Figure 26:
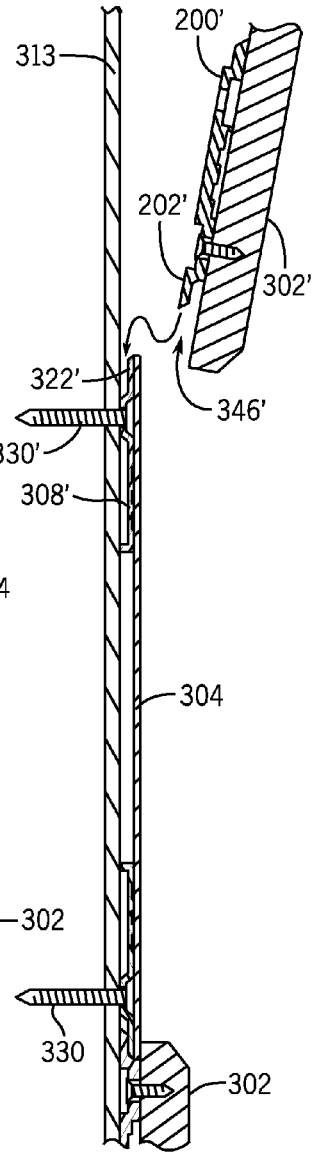
FIG. 26 is a cross-sectional view of a second panel and clip being located relative to the first and second reveal retains, extended reveal, first clip, and first panel of FIG. 20 according to an exemplary embodiment.
Figure 26A:
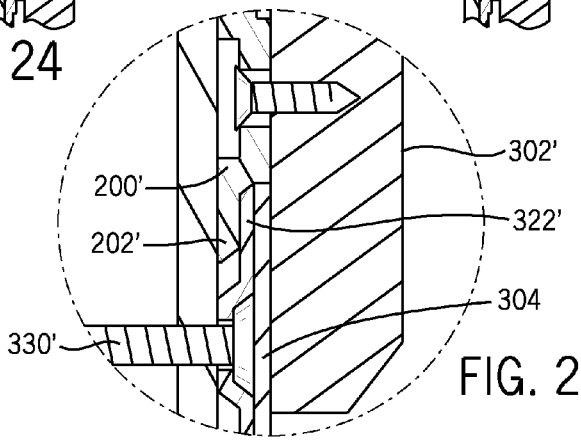
FIG. 26A is a detail view of the second clip and panel located relative to the second reveal retainer and extended reveal according to an exemplary embodiment.

With reference to FIGS. 21-23, in one embodiment, a panel 302 is coupled to a clip 200, as described above. The upper leg portion 230 of the clip 200 and the panel 302 define an upwardly opening slot 346, e.g., with an open upper end. The lower portion 314 of the reveal retainer 308 is configured to be located in the slot 346. The reveal retainer 308, located with the lower portion 314 in the slot 346, is coupled to the elevator cab wall 313 by a fastener shown as a screw 330 extending through the throughbore 322. The recessed portion 320 of the reveal retainer 308 is configured such that the head of the screw 330 does not extend past the second surface 318 of the lower portion 314 when the screw 330 is in the throughbore 322. The extended reveal portion 304 is also located in the slot 346 with the lower portion 314 of the reveal retainer 308, with the reveal retainer 308 spacing the extended reveal portion 304 from the elevator cab wall 313 and deterring movement of the extended reveal portion 304 in a direction perpendicularly toward the elevator cab wall 313.

With reference to FIGS. 24-26A, another reveal retainer 308' is provided. In one embodiment, the reveal retainer 308' is identical, e.g., substantially identical to the reveal retainer 308. The reveal retainer 308' is in an opposite, upside down orientation relative to the reveal retainer 308, e.g., rotated 180° about an axis perpendicular to the wall 313, for example, the longitudinal axis of the screw 330'. The reveal retainer 308' is coupled to the elevator cab wall 313 by a fastener shown as a screw 330' extending through the throughbore 322'. Another panel 302' with another clip 200' coupled thereto is provided. The lower leg portion 202' of the clip 200' and the panel 302' define a downwardly opening slot 346', e.g., with open lower end, configured to receive the portion 322' of the reveal retainer 308' and the extended reveal portion 304 therein.

Figure 27:
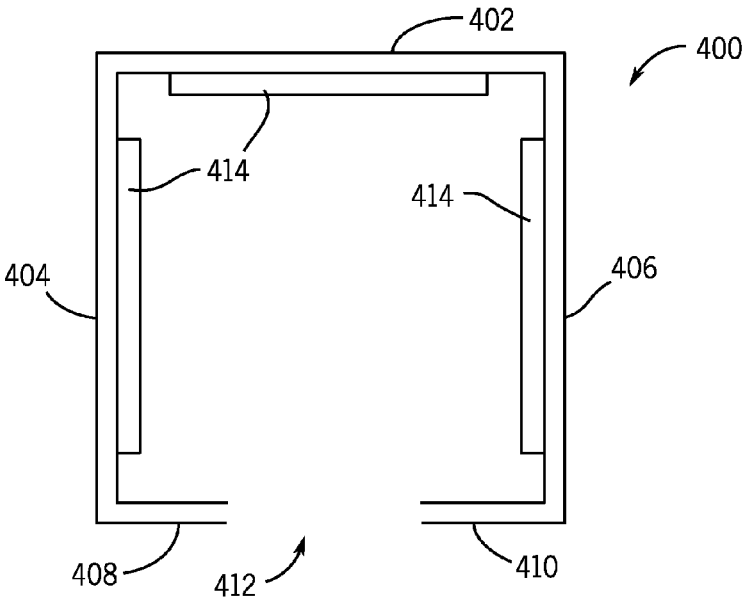
FIG. 27 is a top plan view shown schematically of an elevator cab according to an exemplary embodiment.

With reference to FIG. 27, a top plan view of an elevator cab 400 is illustrated according to an exemplary embodiment. The elevator cab 400 has a back wall 402, a first side wall 404, a second side wall 406, a first front wall 408, and a second front wall 410. The first and second front walls 408 and 410 define a door opening 412 therebetween. Panels 414, such as panels described above, are hung on the walls.

Figure 28:
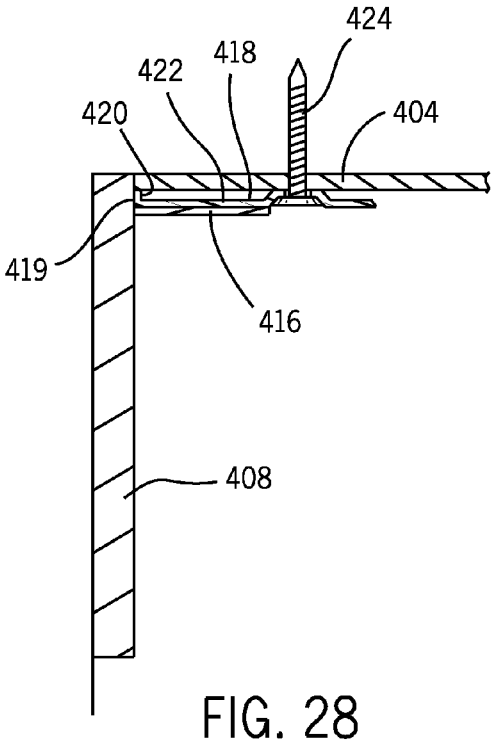
FIG. 28 is a top plan view shown schematically of a vertical reveal and reveal retainer located relative to two of the elevator cab walls of FIG. 22 according to an exemplary embodiment.
Figure 29:
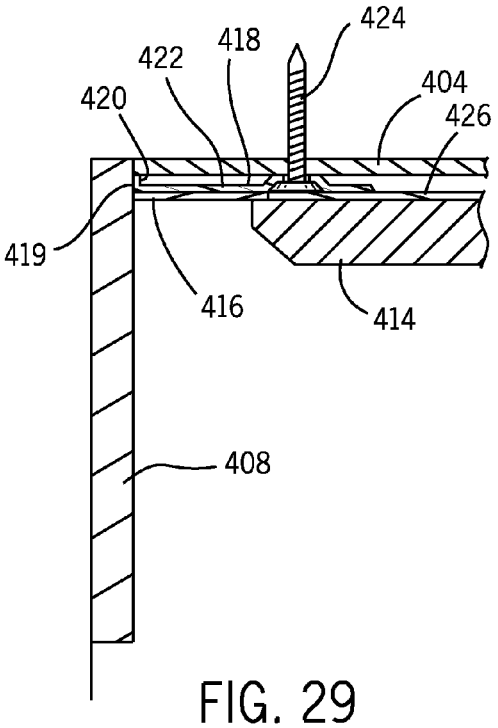
FIG. 29 is a top plan view shown schematically of a panel and horizontal reveal located relative to the vertical reveal and reveal retainer of FIG. 23 according to an exemplary embodiment.

With reference to FIG. 28, in one embodiment, a vertical strip, e.g., extended length of metal sheet, etc., shown as a vertical reveal 416 is coupled to an elevator cab wall and located relative to the elevator cab wall using a reveal retainer 418 identical, e.g., substantially identical, to the reveal retainers 308 described above. The reveal retainer 418 is rotated 90° relative to the reveal retainers 308 described above in the elevator cab. The reveal retainer 418 is located with a first end 419 flush against the first front wall 408 and a flange 420 spacing a second portion 422 of the reveal retainer 418 from the first side wall 404. The vertical reveal 416 is coupled, e.g., by a fastener, adhesive, tape, etc., to the side of the second portion 422 opposite the first sidewall 404. The reveal retainer 418 is coupled to the wall 404 by a fastener shown as a screw 424. With reference to FIG. 29, the panel 414 overlies a portion of the vertical reveal 416. A horizontal reveal 426 installed, such as, for example, as described above, overlies a portion of the reveal retainer 418 and is located spaced apart from the wall 404 by the reveal retainer 418 to align with and abut the vertical reveal 416. A vertical reveal may be similarly (e.g., mirror image) installed in the corner between the second sidewall 406 and the second front wall 410.

Figure 30:
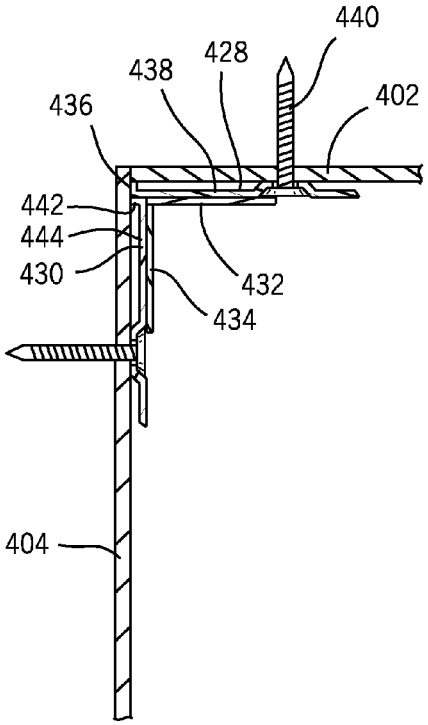
FIG. 30 is a top plan view shown schematically of a pair of reveal retainers and vertical reveals located relative to two of the elevator cab walls of FIG. 22 according to an exemplary embodiment.
Figure 31:
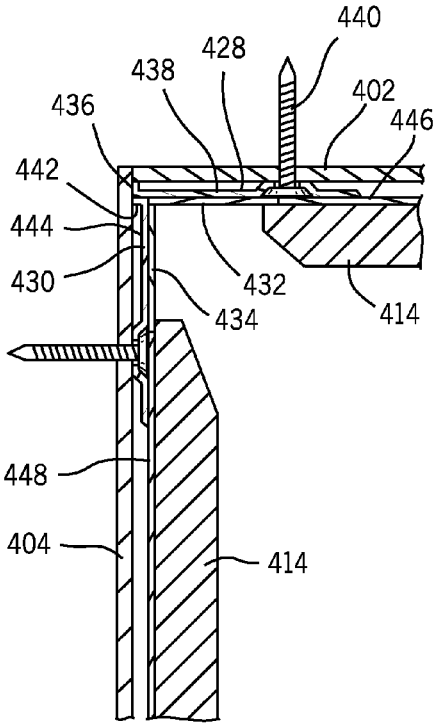
FIG. 31 is a top plan view shown schematically of a pair of panels and horizontal reveals located relative to the pair of reveal retainers and vertical reveals of FIG. 25 according to an exemplary embodiment.

With reference to FIG. 30, a pair of reveal retainers 428 and 430 support and locate vertical reveals 432 and 434 in the corner between the rear wall 402 and the first sidewall 404. The reveal retainers 428 and 430 are identical, e.g., substantially identical, to the reveal retainer 418 described above. The first reveal retainer 428 includes a flange 436 that is located flush against the wall 404 and spaces a second portion 438 of the reveal retainer 428 away from the wall 402. The vertical reveal 432 is coupled, e.g., by adhesive, tape, etc., to the second portion 428 on an opposite side from the wall 402. The reveal retainer 428 is coupled to the wall 402 by a fastener shown as a screw 440. The second reveal retainer 430 includes a flange 442 that abuts the second portion 438 of the reveal retainer 428 and spaces the second portion 444 of the reveal retainer 430 away from the wall 404. The vertical reveal 434 is coupled, e.g., by adhesive, tape, etc., to the second portion 444 on an opposite side from the wall 404. The vertical reveals 432 and 434 are thus positioned abutting one another and forming a corner. With reference to FIG. 31, the panels 414 each overlie a portion of one of the vertical reveals 432 and 434. Horizontal reveals 446 and 448 installed, such as, for example, as described above, overlie a portion of the reveal retainers 428 and 430 and are located spaced apart from the walls 402 and 404 by the reveal retainers 428 and 430 to align with and abut the vertical reveals 432 and 434. Vertical reveals may be similarly (e.g., mirror image) installed in the corner between the back wall 402 and the second sidewall 406.

In one embodiment, elevator cab interior protection systems such as those described may include panels with clips attached to the panels in predetermined locations, based on elevator cab dimensions, etc. The panels may be attached to clips at a physical location different than the location at which the system will be installed into the elevator cab, e.g., the panels and clips can be screwed together at a factory and then the panels may be hung in the elevator cab, with the clips not needing to be screwed to the panels at the elevator cab location. The lowest panel may be hung on a toe kick plate using a lower clip and a fastener may be inserted into an upper clip to attach the panel to the wall. The next lowest panel may then be hung with its lower clip interfacing with the upper clip of the lower panel. Thus, the elevator cab interior protection system may be installed without the need to drive a fastener through the panels, either to attach a clip to a panel or to attach a panel to the elevator cab wall, and, therefore, the system may be installed easily and with the installation system minimizing the opportunity for mistakes, e.g., mis-measuring, driving a fastener through a panel in an incorrect location, etc.

In various embodiments, panels of the systems described herein are fire and/or heat resistant, e.g., provide fire protection for the walls of the elevator cab and/or occupants of the elevator cab. In various embodiments, panels described above may be formed from, for example, particle board, modified density fiberboard, plastic, high pressure laminate, phenolic paper, wood, etc.

In various embodiments, fasteners described above may include, nails, screws, bolts, glues, epoxies, other adhesives, or any other suitable type of fastener.

In various embodiments, the clips having a width less than the width of the panels allows for ease of installation in contrast to other systems in which materials must be cut to length onsite, which may increase the possibility for errors, e.g., cutting errors, measuring errors, etc. In various embodiments, systems for protection of elevator cab interior described herein are lower cost and lower weight than other cab protection systems.

In various embodiments, clips and reveal retainers described herein may be extruded. In other embodiments, clips and reveal retainers may be molded. In other embodiments, other suitable forming methods may be used. In one embodiment, clips and reveal retainers are formed from plastic. In another embodiment, clips and reveal retainers are formed from plastic. In another embodiment, clips and reveal retainers may be formed from metal. In one embodiment, the clips and reveal retainers may each be formed from different materials.

In one embodiment, the reveal strips and extended reveal portion described above are formed from metal, e.g., stainless steel, etc. In other embodiments, the reveal strips and extended reveal portion described above are formed from plastic, high pressure laminate, metal, etc. In other embodiments, other suitable materials may be used.

It should be understood that the figures illustrate the exemplary embodiments in detail, and it should be understood that the present application is not limited to the details or methodology set forth in the description or illustrated in the figures. It should also be understood that the terminology is for the purpose of description only and should not be regarded as limiting.

Further modifications and alternative embodiments of various aspects of the invention will be apparent to those skilled in the art in view of this description. Accordingly, this description is to be construed as illustrative only. The construction and arrangements, shown in the various exemplary embodiments, are illustrative only. Although only a few embodiments have been described in detail in this disclosure, many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter described herein. Some elements shown as integrally formed may be constructed of multiple parts or elements, the position of elements may be reversed or otherwise varied, and the nature or number of discrete elements or positions may be altered or varied. The order or sequence of any process, logical algorithm, or method steps may be varied or re-sequenced according to alternative embodiments. Other substitutions, modifications, changes and omissions may also be made in the design, operating conditions and arrangement of the various exemplary embodiments without departing from the scope of the present invention.

For purposes of this disclosure, the term "coupled" means the joining of two components directly or indirectly to one another. Such joining may be stationary in nature or movable in nature. Such joining may be achieved with the two members and any additional intermediate members being integrally formed as a single unitary body with one another or with the two members or the two members and any additional member being attached to one another. Such joining may be permanent in nature or alternatively may be removable or releasable in nature.

While the current application recites particular combinations of features in the claims appended hereto, various embodiments of the invention relate to any combination of any of the features described herein whether or not such combination is currently claimed, and any such combination of features may be claimed in this or future applications. Any of the features, elements, or components of any of the exemplary embodiments discussed above may be used alone or in combination with any of the features, elements, or components of any of the other embodiments discussed above.

In various exemplary embodiments, the relative dimensions, including angles, lengths and radii, as shown in the Figures are to scale. Actual measurements of the Figures will disclose relative dimensions, angles and proportions of the various exemplary embodiments. Various exemplary embodiments extend to various ranges around the absolute and relative dimensions, angles and proportions that may be determined from the Figures. Various exemplary embodiments include any combination of one or more relative dimensions or angles that may be determined from the Figures. Further, actual dimensions not expressly set out in this description can be determined by using the ratios of dimensions measured in the Figures in combination with the express dimensions set out in this description.

What is claimed is:

1. An elevator cab protection system for an elevator cab having at least one wall the system comprising:

a first panel extending a first height from a lower end to an upper end and a first width from a first end to a second end;

a second panel extending a second height from a lower end to an upper end and a second width from a first end to a second end; and three clips each extending a third width from a first end to a second end, each of the clips including a lower leg portion, an upper leg portion, a lower throughbore, and an upper throughbore, the first clip being coupled to the first panel by a first fastener extending through the lower throughbore, the lower leg portion of the first clip and the first panel defining a first downwardly opening slot, the second clip being coupled to the first panel by a second fastener with the upper leg portion of the second clip being located above the upper end of the first panel and being configured to define with the at least one wall of the elevator cab a first upwardly opening slot, the third clip being coupled to the second panel by a third fastener, the lower leg portion of the third clip being configured to be inserted into the first upwardly opening slot defined by the upper leg portion of the second clip and the at least one wall of the elevator cab to support the second panel relative to the first panel, wherein the third width is less than the first width;

wherein each of the clips includes a lower portion configured to abut a panel and a wall portion spaced apart from the lower portion, the lower portion and the wall portion defining a channel therebetween; and a metal strip, wherein the channel is configured to receive the metal strip.

2. The elevator cab protection system of claim 1, further comprising a fourth fastener configured to be inserted through the upper throughbore of the second clip to couple the second clip to the at least one wall of the elevator cab.

3. The elevator cab protection system of claim 1, further comprising a fourth clip coupled to the second panel, the fourth clip and the second panel defining a second upwardly opening slot.

4. The elevator cab protection system of claim 3, further comprising an upper panel having a downwardly extending flange configured to be received in the upwardly opening slot and an upwardly extending flange configured to be coupled to the at least one wall of the elevator cab.

5. The elevator cab protection system of claim 1, wherein the clips are identical.

6. The elevator cab protection system of claim 1, wherein the third width is less than the second width and wherein the system does not include a fastener extending through both the at least one wall of the elevator cab and the first panel.

7. An elevator cab protection system for an elevator cab having at least one wall the system comprising:

a first panel extending a first height from a lower end to an upper end and a first width from a first end to a second end;

a second panel extending a second height from a lower end to an upper end and a second width from a first end to a second end; and three clips each extending a third width from a first end to a second end, each of the clips including a lower leg portion, an upper leg portion, a lower throughbore, and an upper throughbore, the first clip being coupled to the first panel by a first fastener extending through the lower throughbore, the lower leg portion of the first clip and the first panel defining a first downwardly opening slot, the second clip being coupled to the first panel by a second fastener with the upper leg portion of the second clip being located above the upper end of the first panel and being configured to define with the at least one wall of the elevator cab a first upwardly opening slot, the third clip being coupled to the second panel by a third fastener, the lower leg portion of the third clip being configured to be inserted into the first upwardly opening slot defined by the upper leg portion of the second clip and the at least one wall of the elevator cab to support the second panel relative to the first panel, wherein the third width is less than the first width; and a fourth clip coupled to the second panel, the fourth clip and the second panel defining a second upwardly opening slot, a first retainer including a downwardly extending portion configured to be received in the second upwardly opening slot and a throughbore configured to receive a fastener therethrough to couple the retainer to the at least one elevator cab wall, and a metal strip configured to be received in the second upwardly opening slot with the downwardly extending portion of the first retainer.

8. The elevator cab protection system of claim 7, further comprising a second retainer identical to the first retainer, the second retainer being configured to be coupled to the at least one wall of the elevator cab in an orientation rotated 180° about an axis perpendicular to the at least one elevator cab wall relative to the first retainer.

9. The elevator cab protection system of claim 8, wherein the first and second retainers are configured to space the metal strip apart from the at least one elevator cab wall.

10. The elevator cab protection system of claim 7, further comprising a bottom panel including a ledge and a reveal strip supported by the ledge, the bottom panel defining with the at least one wall of the elevator cab a second upwardly opening slot configured to receive the lower leg portion of the first clip to located the first panel relative to the bottom panel.

11. An elevator cab protection system for an elevator cab having at least one wall, the system comprising:

a first clip coupled to a first panel by a first fastener, the panel having an upper peripheral edge, the first clip defining a channel extending from below the upper peripheral edge of the panel to a wall above the upper peripheral edge of the panel;

a metal strip configured to be located in the channel having a lower peripheral edge below the upper peripheral edge of the panel and an upper peripheral edge above the upper peripheral edge of the panel; and a second clip coupled to a second panel by a second fastener, the second panel having a lower peripheral edge, the second clip having a downwardly extending leg portion extending downwardly to a lower peripheral edge above the lower peripheral edge of the second panel, the downwardly extending leg portion and the panel defining a downwardly opening slot;

wherein a portion of the first clip is configured to be received into the downwardly opening slot to locate the second panel relative to the first panel; and wherein the first clip and the second clip are identical.

12. The elevator cab protection system of claim 11, further comprising a second fastener configured to couple the first clip to the at least one wall of the elevator cab.

13. The elevator cab protection system of claim 11, wherein the lower peripheral edge of the second panel is configured to be located below the upper peripheral edge of the metal strip with the portion of the first clip located in the downwardly opening slot.

14. The elevator cab protection system of claim 11, wherein the first panel has a first width, the first clip has a second width, and the first width is greater than the second width.

15. The An elevator cab protection system for an elevator cab having at least one wall, the system comprising:

a first clip coupled to a first panel by a first fastener, the panel having an upper peripheral edge, the first clip defining a channel extending from below the upper peripheral edge of the panel to a wall above the upper peripheral edge of the panel;

a metal strip configured to be located in the channel having a lower peripheral edge below the upper peripheral edge of the panel and an upper peripheral edge above the upper peripheral edge of the panel; and a second clip coupled to a second panel by a second fastener, the second panel having a lower peripheral edge, the second clip having a downwardly extending leg portion extending downwardly to a lower peripheral edge above the lower peripheral edge of the second panel, the downwardly extending leg portion and the panel defining a downwardly opening slot;

wherein a portion of the first clip is configured to be received into the downwardly opening slot to locate the second panel relative to the first panel;

wherein the first clip includes a planar portion extending along a first plane, the planar portion defining an aperture through which the fastener coupling the clip to the first panel extends and the first clip includes an upper leg portion having a first surface abutting the second panel and extending along a second plane;

wherein the first plane and the second plane are co-planar.

16. An elevator cab protection system for an elevator cab having at least one wall, the system comprising:

first and second panels each having an upper edge, a lower edge, and first and second sides each extending from the upper edge to the lower edge;

a first clip coupled to the first panel by a first fastener and extending past the upper edge of the first panel, the first clip including a leg portion that with the at least one wall is configured to define an upwardly opening channel;

a second clip coupled to the first panel by a second fastener and extending past the first side of the first panel, the second clip including a leg portion that with the at least one wall of the elevator cab is configured to define a second channel having a first open end and a second closed end; and a third clip coupled to the second panel by a third fastener, the third clip including a leg portion that with the panel defines a third channel having a first open end and a second closed end, the leg portion of the third clip being configured to be located in the second channel to locate the second panel horizontally relative to the first panel.

* * * * *